United States Patent [19]

Kubozuka

[11] Patent Number: 4,662,316

[45] Date of Patent: May 5, 1987

[54] COOLING SYSTEM FOR AUTOMOTIVE ENGINE OR THE LIKE

[75] Inventor: Takao Kubozuka, Yokosuka, Japan

[73] Assignee: Nissan Motor Co., Ltd., Yokohama, Japan

[21] Appl. No.: 823,650

[22] Filed: Jan. 29, 1986

[51] Int. Cl.[4] ..... F01P 3/22; F01P 11/18

[52] U.S. Cl. ..... 123/41.15; 123/41.21; 123/41.27

[58] Field of Search ..... 123/41.15, 41.21, 41.27, 123/198 DB, 198 DC

[56] References Cited

U.S. PATENT DOCUMENTS 4,454,843 6/1984 Uchida et al. ..... 123/198 DB
4,487,180 12/1984 Ito et al. ..... 123/41.15
4,548,183 10/1985 Hayashi ..... 123/41.15
4,554,891 11/1985 Hayashi ..... 123/41.15
4,556,029 12/1985 Yamaguchi et al. ..... 123/41.15

*Primary Examiner*—William A. Cuchlinski, Jr.
*Attorney, Agent, or Firm*—Schwartz, Jeffery, Schwaab, Mack, Blumenthal & Evans

[57] ABSTRACT

In order to predict a system malfunction which will lead to overheat and thermal damage of the engine the operation of a level sensor which controls the level of coolant in the coolant jacket of the engine is monitored and in the event that frequency or the time for which the level sensor indicates a low level, falls outside of a predetermine range which defines malfunction free operation, a warning of impending engine overheat or the like is issued.

8 Claims, 19 Drawing Figures

COOLING SYSTEM FOR AUTOMOTIVE ENGINE OR THE LIKE

BACKGROUND OF THE INVENTION

1. Field of the Invention

The present invention relates generally to an evaporative type cooling system for an internal combustion engine wherein liquid coolant is permitted to boil and the vapor used as a vehicle for removing heat therefrom, and more specifically to such a system which is able to monitor the operation of various elements thereof and detect abnormal conditions such as a chronic insufficiency of liquid coolant in the coolant jacket.

2. Description of the Prior Art

In currently used 'water cooled' internal combustion engines such as shown in FIG. 1 of the drawings, the engine coolant (liquid) is forcefully circulated by a water pump, through a cooling circuit including the engine coolant jacket and an air cooled radiator. This type of system encounters the drawback that a large volume of water is required to be circulated between the radiator and the coolant jacket in order to remove the required amount of heat. Further, due to the large mass of water inherently required, the warm-up characteristics of the engine are undesirably sluggish. For example, if the temperature difference between the inlet and discharge ports of the coolant jacket is 4 degrees, the amount of heat which 1 Kg of water may effectively remove from the engine under such conditions is 4 Kcal. Accordingly, in the case of an engine having an 1800 cc displacement (by way of example) is operated full throttle, the cooling system is required to remove approximately 4000 Kcal/h. In order to achieve this, a flow rate of 167 liter/min must be produced by the water pump. This of course undesirably consumes a number of otherwise useful horsepower.

Further, the large amount of coolant utilized in this type of system renders the possibility of quickly changing the temperature of the coolant in a manner that instant coolant temperature can be matched with the instant set of engine operational conditions such as load and engine speed, completely out of the question.

FIG. 2 shows an arrangement disclosed in Japanese Patent Application Second Provisional Publication Sho. 57-57608. This arrangement has attempted to vaporize a liquid coolant and use the gaseous form thereof as a vehicle for removing heat from the engine. In this system the radiator 1 and the coolant jacket 2 are in constant and free communication via conduits 3, 4 whereby the coolant which condenses in the radiator 1 is returned to the coolant jacket 2 little by little under the influence of gravity.

This arrangement while eliminating the power consuming coolant circulation pump which plagues the above mentioned arrangement has suffered from the drawbacks that the radiator, depending on its position with respect to the engine proper, tends to be at least partially filled with liquid coolant. This greatly reduces the surface area via which the gaseous coolant (for example steam) can effectively release its latent heat of vaporization and accordingly condense, and thus has lacked any notable improvement in cooling efficiency.

Further, with this system in order to maintain the pressure within the coolant jacket and radiator at atmospheric level, a gas permeable water shedding filter 5 is arranged as shown, to permit the entry of air into and out of the system. However, this filter permits gaseous coolant to readily escape from the system, inducing the need for frequent topping up of the coolant level.

A further problem with this arrangement has come in that some of the air, which is sucked into the cooling system as the engine cools, tends to dissolve in the water, whereby upon start up of the engine, the dissolved air tends to come out of solution and form small bubbles in the radiator which adhere to the walls thereof and form an insulating layer. The undissolved air also tends to collect in the upper section of the radiator and inhibit the convection-like circulation of the vapor from the cylinder block to the radiator. This of course further deteriorates the performance of the device.

Moreover, with the above disclosed arrangement the possibility of varying the coolant temperature with load is prevented by the maintainance of the internal pressure of the system constantly at atmospheric level.

European Patent Application Provisional Publication No. 0 059 423 published on Sept. 8, 1982 discloses another arrangement wherein, liquid coolant in the coolant jacket of the engine, is not forcefully circulated therein and permitted to absorb heat to the point of boiling. The gaseous coolant thus generated is adiabatically compressed in a compressor so as to raise the temperature and pressure thereof and thereafter introduced into a heat exchanger (radiator). After condensing, the coolant is temporarily stored in a reservoir and recycled back into the coolant jacket via a flow control valve.

This arrangement has suffered from the drawback that when the engine is stopped and cools down the coolant vapor condenses and induces sub-atmospheric conditions which tend to induce air to leak into the system. This air tends to be forced by the compressor along with the gaseous coolant into the radiator. Due to the difference in specific gravity, the air tends to rise in the hot environment while the coolant which has condensed moves downwardly. The air, due to this inherent tendency to rise, forms pockets of air which cause a kind of 'embolism' in the radiator and which badly impair the heat exchange ability thereof. With this arrangement the provision of the compressor renders the control of the pressure prevailing in the cooling circuit for the purpose of varying the coolant boiling point with load and/or engine speed difficult.

U.S. Pat. No. 4,367,699 issued on Jan. 11, 1983 in tbhe name of Evans (see FIG. 3 of the drawings) discloses an engine system wherein the coolant is boiled and the vapor used to remove heat from the engine. This arrangement features a separation tank 6 wherein gaseous and liquid coolant are initially separated. The liquid coolant is fed back to the cylinder block 7 under the influence of gravity while the relatively dry gaseous coolant (steam for example) is condensed in a fan cooled radiator 8.

The temperature of the radiator is controlled by selective energizations of the fan 9 which maintains a rate of condensation therein sufficient to provide a liquid seal at the bottom of the device. Condensate discharged from the radiator via the above mentioned liquid seal is collected in a small reservoir-like arrangement 10 and pumped back up to the separation tank via a small constantly energized pump 11.

This arrangement, while providing an arrangement via which air can be initially purged to some degree from the system tends to, due to the nature of the arrangement which permits said initial non-condensible matter to be forced out of the system, suffers from rapid loss of coolant when operated at relatively high altitudes. Further, once the engine cools air is relatively freely admitted back into the system. The provision of the bulky separation tank 6 also renders engine layout difficult.

Further, the rate of condensation in the consensor is controlled by a temperature sensor disposed on or in the condensor per se in a manner which holds the pressure and temperature within the system essentially constant. Accordingly, temperature variation with load is rendered impossible.

Japanese Patent Application First Provisional Publication No. sho. 56-32026 (see FIG. 4 of the drawings) discloses an arrangement wherein the structure defining the cylinder head and cylinder liners are covered in a porous layer of ceramic material 12 and wherein coolant is sprayed into the cylinder block from shower-like arrangements 13 located above the cylinder heads 14. The interior of the coolant jacket defined within the engine proper is essentially filled with gaseous coolant during engine operation at which time liquid coolant sprayed onto the ceramic layers 12.

However, this arrangement has proven totally unsatisfactory in that upon boiling of the liquid coolant absorbed into the ceramic layers, the vapor thus produced and which escapes into the coolant jacket, inhibits the penetration of fresh liquid coolant and induces the situation wherein rapid overheat and thermal damage of the ceramic layers 12 and/or engine soon results. Further, this arrangement is of the closed circuit type and is plagued with air contamination and blockages in the radiator similar to the compressor equipped arrangement discussed above.

FIG. 7 shows an arrangement which is disclosed in U.S. Pat. No. 4,549,505 issued on Oct. 29, 1985 in the name of Hirano. The disclosure of this application is hereby incorporated by reference thereto.

For convenience the same numerals as used in the above mentioned Patent are also used in FIG. 7.

This arrangement while overcomming the problems inherent in the above discussed prior art suffers from the drawback that a prolonged or chronic lack of coolant in the coolant jacket 120 tends to go undetected until such time as an abnormally high temperature occurs (viz., the output of temperature sensor 144 suddenly rises due to non-immersion in liquid coolant and direction exposure to the heat radiation from the highly heated structure of the engine (cylinder head, exhaust valves, ports etc.). However, by the time that the lack of coolant is detected in this manner it is usually too late to execute measures to save the engine from overheat, seizure and the like thermal damage.

SUMMARY OF THE PRESENT INVENTION

It is an object of the present invention to provide a cooling system for an internal combustion engine or the like device which enables possible engine overheat to be predicted sufficiently ahead of the actual event to permit steps to be taken to obviate the same.

In brief, the above mentioned objects is achieved by an arrangement wherein in order to predict a system malfuction which will lead to overheat and thermal damage of the engine the operation of a level sensor which controls the level of coolant in the coolant jacket of the engine is monitored and in the event that frequency or the time for which the level sensor indicates a low level falls outside of a predetermined range which defines malfunction free operation, a warning of impending engine overheat or the like is issued.

More specifically, a first aspect of the present invention comes in the form of an internal combustion engine having a structure subject to high heat flux and which features a cooling system for removing heat from the engine comprising: a coolant jacket formed about the structure, the coolant jacket being arranged to receive coolant in liquid form and discharge same in gaseous form; a radiator in which the gaseous coolant produced in the coolant jacket is condensed to its liquid form; a vapor transfer conduit leading from the coolant jacket to the radiator for transfering gaseous coolant from the coolant jacket to the radiator; a device associated with the radiator for varying the rate of heat exchange between the radiator and a cooling medium surrounding the radiator; a liquid coolant return conduit leading from the radiator to the coolant jacket for returning coolant condensed to its liquid state in the radiator to the coolant jacket; the coolant jacket, radiator, vapor transfer conduit and the liquid coolant return conduit defining a closed loop cooling circuit; a reservoir the interior of which is maintained constantly at atmospheric pressure; valve and conduit means for selectively interconnecting the reservoir and the cooling circuit; a pump disposed in the coolant return conduit; a first level sensor disposed in the coolant jacket and arranged to sense the level of lquid coolant in the coolant jacket at a first predetermined level above the structure, the first predetermined level being selected to immerse the structure in a predetermined depth of liquid coolant; a control circuit responsive to the first level sensor for controlling the operation of the pump in a manner to maintain the level of liquid coolant in the coolant jacket at the first predetermined level; the control circuit including means which monitors the output of the first level sensor and which issues a warning in the event that the one of the frequency and time for which the pump is operated is outside of a predetermined range which defines malfunction free operation of the cooling system.

A second aspect of the present invention comes in a method of cooling an internal combustion engine using a cooling system comprising the steps of: introducing liquid coolant into a cooling circuit which includes a coolant jacket formed about structure of the engine subject to a high heat flux; permitting the coolant in the coolant jacket to boil and produce coolant vapor; transferring the coolant vapor to a radiator which defines a further section of the cooling circuit; condensing the coolant vapor to its liquid form in the radiator; sensing the level of coolant in the coolant jacket using a level sensor, the level sensor being arranged to sense the level of coolant being above a predetermined level which ensures that the structure is immersed in a predetermined depth of liquid coolant; monitoring the output of the level sensor; and determining the possibility of a malfunction in the cooling system in the event that one of the frequency and time for which the sensor indicates a level lower than the predetermined one, is not in a range determined to define malfunction free operation.

BRIEF DESCRIPTION OF THE DRAWINGS

The features and advantages of the arrangement of the present invention will become more clearly appreciated from the following description taken in conjunction with the accompanying drawings in which.

DETAILED DESCRIPTION OF THE PREFERRED EMBODIMENTS

Before proceeding with the description of the embodiments of the present invention, it is deemed appropriate to discuss some of the basic features of the type of cooling system to which the present invention is directed.

Figure 7:
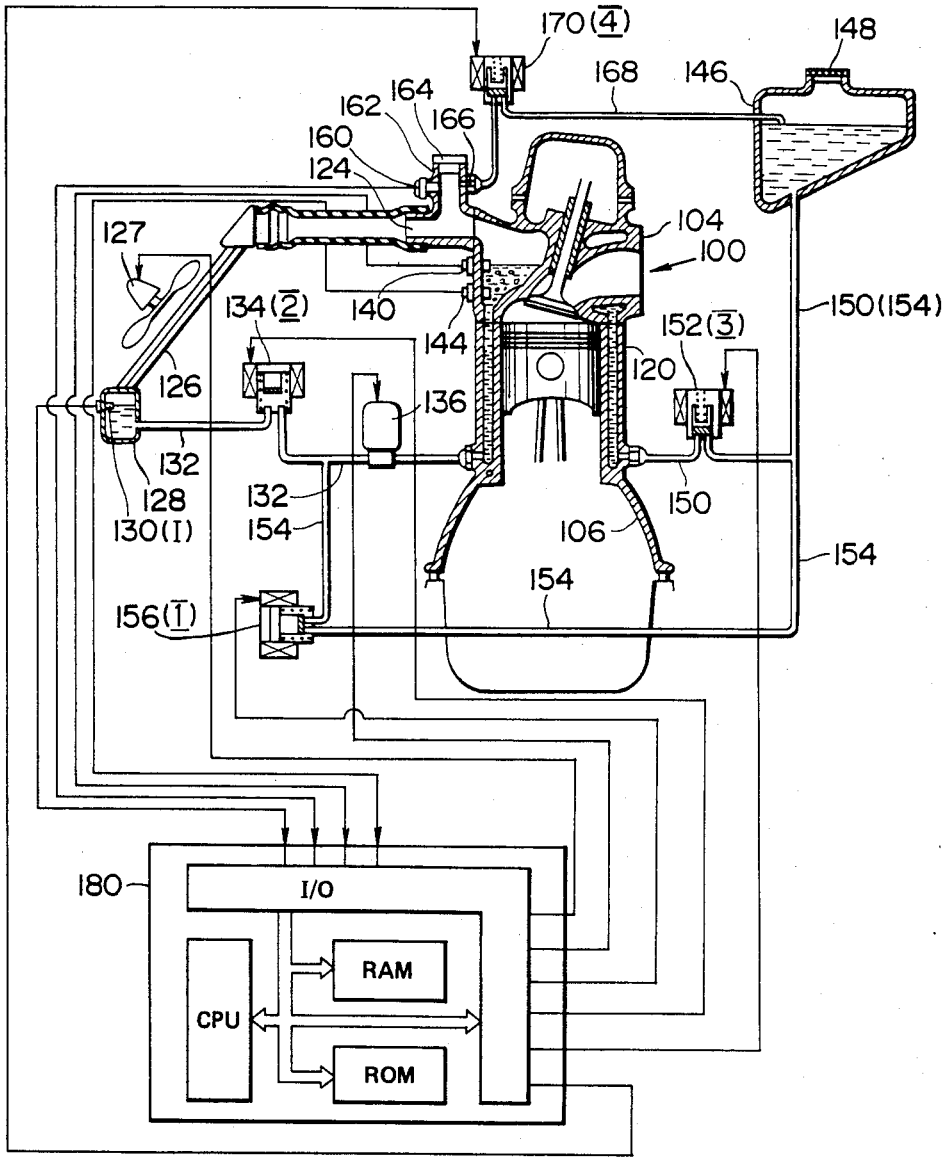
FIG. 7 shows in schematic elevation the arrangement disclosed in the opening paragraphs of the instant disclosure in conjunction with U.S. Pat. No. 4,549,505.

FIG. 7 graphically shows in terms of engine torque and engine speed the various load 'zones' which are encountered by an automotive vehicle engine. In this graph, the curve F denotes full throttle torque characteristics, trace R/L denotes the resistance encountered when a vehicle is running on a level surface, and zones A, B and C denote respectively low load/low engine speed operation such as encountered during what shall be referred to 'urban cruising'; low speed high/load engine operation such as hillclimbing, towing etc., and high engine speed operation such as encountered during high speed cruising.

A suitable coolant temperature for zone A is approximately 100°-110° C.; for zone B 80°-90° C. and for zone C 90°-100° C. The high temperature during 'urban cruising' promotes improved thermal efficiency. On the other hand the lower temperatures of zones B and C are such as to ensure that sufficient heat is removed from the engine and associated structure to prevent engine knocking and/or thermal damage.

With the present invention, in order to control the temperature of the engine, advantage is taken of the fact that with a cooling system wherein the coolant is boiled and the vapor used as a heat transfer medium, the amount of coolant actually circulated between the coolant jacket and the radiator is very small, the amount of heat removed from the engine per unit volume of coolant is very high, and upon boiling, the pressure prevailing within the coolant jacket and consequently the boiling point of the coolant rises if the system employed is of the closed circuit type. Thus, during urban cruising by circulating only a limited amount of cooling air over the radiator, it is possible reduce the rate of condensation therein and cause the pressure within the cooling system to rise above atmospheric and thus induce the situation, wherein the engine coolant boils at temperatures above 100° C. for example at approximately 110° C.

In addition to the control afforded by the air circulation the present invention is arranged to positively pump coolant into the system so as to vary the amount of coolant actually in the cooling circuit in a manner which modifies the pressure prevailing therein. The combination of the two controls enables the temperature at which the coolant boils to be quickly brought to and held close to that deemed most appropriate for the instant set of operation conditions.

On the other hand, during high speed cruising for example, when a lower coolant boiling point is highly beneficial, it is further possible by increasing the flow cooling air passing over the radiator, to increase the rate of condensation within the radiator to a level which reduces the pressure prevailing in the cooling system below atmospheric and thus induce the situation wherein the coolant boils at temperatures in the order of 80° to 100° C. In addition to this, the present invention also provides for coolant to be positively pumped out of the cooling circiut in a manner which lowers the pressure in the system and supplements the control provide by the fan in a manner which permits the temperature at which the coolant boils to be quickly brought to and held at a level most appropriate for the new set of operating conditions.

However, if the pressure in the system drops to an excessively low level the tendancy for air to find its way into the interior of the cooling circuit becomes excessively high and it is desirable under these circumstances to limit the degree to which a negative pressure is permitted to develop. The present invention controls this by again positively pumping coolant into the cooling circuit while it remains in an essentially hermetically sealed state and raises the pressure in the system to a suitable level.

Each of the zones of control be discussed in detail. It should be noted that the figures quoted in this discussion relate to a reciprocating type internal engine having a 1800 cc displacement.

Zone A

In this zone (low speed/low torque) as the torque requirents are not high, emphasis is placed on good fuel economy. Accordingly, the lower limit of the temperature range of 100° to 110° C. is selected on the basis that, above 100° C. the fuel consumption curves of the engine tend to flatten out and become essentially constant. On the other hand, the upper limit of this range is selected in view of the fact that if the temperature of the coolant rises to above 110° C., as the vehicle is inevitably not moving at any particular speed during this mode of operation there is very little natural air circulation within the engine compartment and the temperature of the engine room tends to become sufficiently high as to have an adverse effect on various temperature sensitive elements such as cog belts of the valve timing gear train, elastomeric fuel hoses and the like. Accordingly, as no particular improvement in fuel consumption characteristics are obtained by controlling the coolant temperature to levels in excess of 110° C., the upper limit of Zone A is held thereat.

It has been found that the torque generation characteristics tend to drop off slightly with temperatures above 100° C., accordingly, in order to minimize the loss of torque it is deemed advantageous to set the upper torque limit of zone A in the range of 7 to 10 kgm.

The upper engine speed of this zone is determined in view of that fact that above engine speeds of 2400 to 3600 RPM a slight increase in fuel consumption characteristics can be detected. Hence, as it is fuel economy rather than maximum torque production characteristics which are sought in this zone, the boundry between the low and high engine speed ranges is drawn within the just mentioned engine speed range. It will be of coure appreicated as there are a variety of different types of engines on the market—viz., diesel engines (eg. trucks industrial vehicles), high performance engines (eg. sports cars), low stressed engines for economical urban use vehicles, etc., the above mentioned ranges cannot be specified with any particular type in mind but do hold generally true for all types.

Zone B

In this zone (high torque/low engine speed) torque is of importance. In order to avoid engine knocking, improve engine charging efficiency, reduce residual gas in the engine combustion chambers and maximize torque generation, the temperature range for this zone is selected to span from 80° to 90° C. With this a notable improvment in torque characteristics is possible. Further, by selecting the upper engine speed for this zone to fall in the range of 2,400 to 3,600 RPM it is possible to improve torque generation as compared with the case wherein the coolant temperature is held at 100° C., while simultaneously improving the fuel consumption characteristics.

The lower temperature of this zone is selected in view of the fact that particularly if anti-freeze is mixed with the coolant at a temperature of 80° C. the pressure prevailing in the interior of the cooling system lowers to approximately 630 mmHg. At this pressure the tendancy for atmospheric air to leak in past the gaskets and seals of the engine becomes particularly high. Hence, in order to avoid the need for expensive parts in order to maintain the relatively high negative pressure (viz., prevent crushing of the radiator and interconnecting conduiting) and simultaneously prevent the invasion of air the above mentioned lower limit is selected.

Zone C

In this zone (high speed) as the respiration characteritics of the engine inherently improve, it is not necessary to maintain the coolant temperature as low as in zone B for this purpose. However, as the amount of heat generated per unit time is higher than during the lower speed modes the coolant tends to boil much more vigorously. As a result an increased amount of liquid coolant tends to bump and froth up out of the coolant jacket and find its way into the radiator.

Until the volume of liquid coolant which enters the radiator reaches approximately 3 liters/min. there is little or no adverse effect on the amount of heat which can be released from the radiator. However, in excess of this figure, a marked loss of heat exchange efficiency may be observed. Experiments have shown that by controlling the boiling point of the coolant in the region of 90° C. under high speed cruising the amount of liquid coolant can kept below the critical level and thus the system undergoes no particular adverse loss of heat release characteristics at a time when the maximization of same is vital to prevent engine overheat.

It has been further observed that if the coolant temperature is permitted to rise above 100° C. then the temperature of the engine lubricant tends to rise above 130° C. and undergo uncessarily rapid degredation. This tendancy is particular notable if the ambient temperature is above 35° C. As will be appreciated if the engine oil begins to degrade under high temperature, heat sensitive bearing metals and the like of the engine also undergo damage.

Hence, from the point of engine protection the coolant is controlled within the range of 90°-100° C. once the engine speed has exceeded the value which divides the high and low engine speed ranges.

Embodiment

Figure 8:
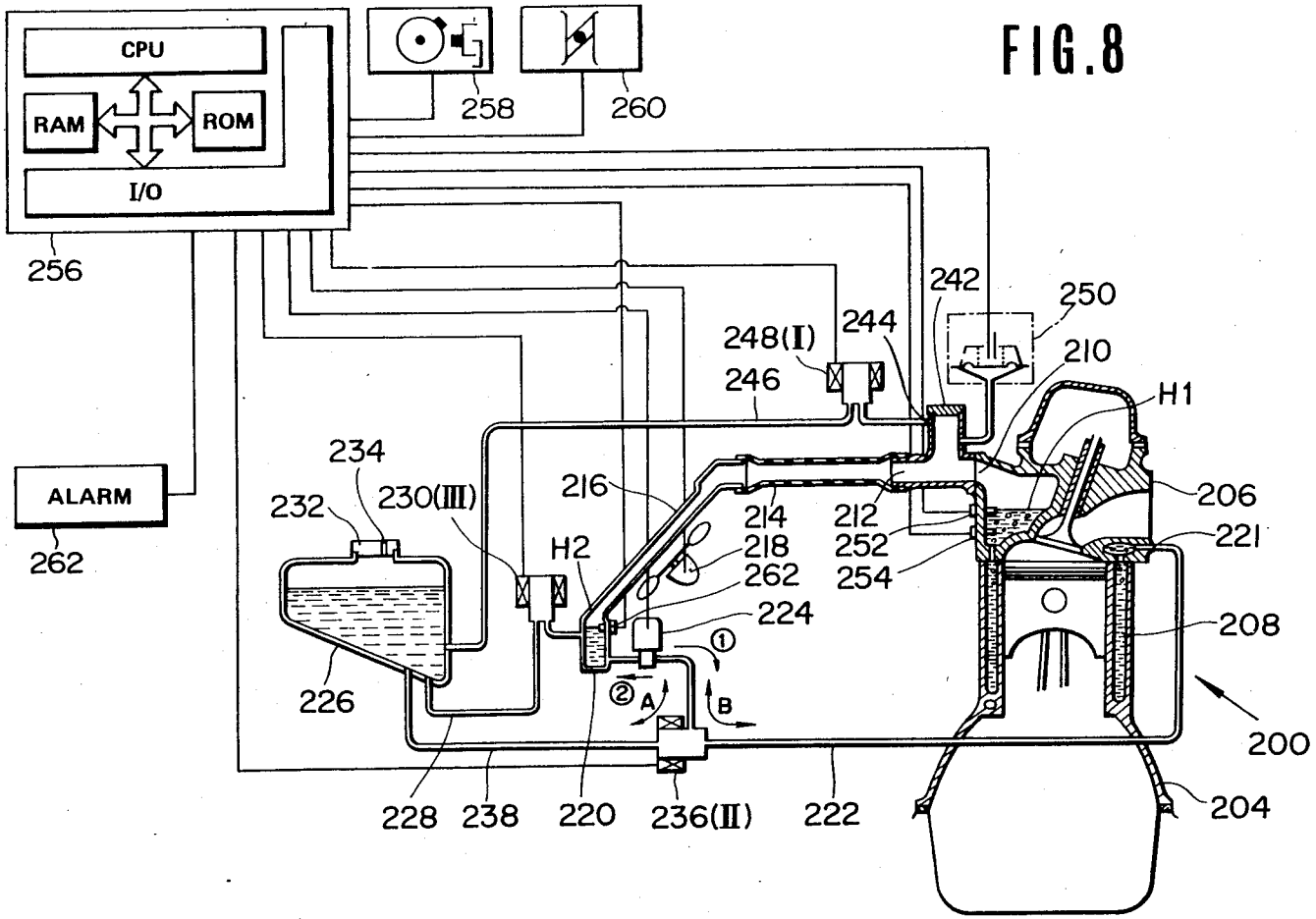
FIG. 8 shows a engine cooling system incorporating an embodiment of the present invention.

FIG. 8 of the drawings shows an embodiment of the present invention. In this arrangement an internal combution engine 200 includes a cylinder block 204 on which a cylinder head 206 is detachably secured. The cylinder head and block are formed with suitably cavities which define a coolant jacket 208 about structure of the engine subject to high heat flux (e.g. combustion chambers exhaust valves conduits etc.,). Fluidly communicating with a vapor discharge port 210 formed in the cylinder head 206 via a vapor manifold 212 and vapor conduit 214, is a condensor 216 or radiator as it will be referred to hereinafter. Located adjacent the raditor 216 is a selectively energizable electrically driven fan 218 which is arranged to induce a cooling draft of air to pass over the heat exchanging surface of the radiator 216 upon being put into operation.

A small collection reservoir 220 or lower tank as it will be referred to hereinlater is provided at the bottom of the radiator 216 and arranged to collect the condensate produced therein. Leading from the lower tank 220 to a coolant inlet port 221 formed in the cylinder head 206 is a coolant return conduit 222. A small capacity electrically driven pump 224 is disposed in this conduit at a location relatively close to the radiator 216. This pump 224 is arranged to reversible—that is energizable so as to induct coolant from the lower tank 220 and pump same toward the coolant jacket 208 (viz., pump coolant in a first flow direction) and energizable so as to pump coolant in the reverse direction (second flow direction)—i.e. induct coolant through the return conduit 222 and pump it into the lower tank 220. The reason for this particular arrangement will become clear hereinlater.

A coolant reservoir 226 is arranged to communicate with the lower tank 220 via a supply conduit 228 in which an electromagnetic flow control valve 230 is disposed. This valve is arranged to closed when energized. The reservoir 226 is closed by a cap 232 in which a air bleed 234 is formed. This permits the interior of the reservoir 226 to be maintained constantly at atmospheric pressure.

A three-way valve 236 is disposed in the coolant return condiut 222 and arranged to communicate with the reservoir 226 via a level control conduit 238. This valve is arranged to have a first state wherein fluid communication is established between the pump 224 and the reservoir 226 (viz., flow path A) and a second state wherein communication between the pump 224 and the coolant jacket 208 is established (viz., flow path B).

The vapor manifold 212 is formed with a riser portion 240. This riser portion 240 as shown, is provided with a cap 242 which hermetically closes same and further formed with a purge port 244. This latter mentioned port 244 communicates with the reservoir 226 via an overflow conduit 246.

A normally closed ON/OFF type electromagnetic valve 248 is dissposed in conduit 246 and arranged to be open only when energized. Also communicating with the riser 240 is a pressure differential responsive diaphragm operated switch arrangement 250 which assumes an open state upon the pressure prevailing within the cooling circuit (viz., the coolant jacket 208, vapor manifold 214, vapor conduit 214, radiator 216 and return conduit) dropping below atmospheric pressure by a predetermined amount. In this embodiment the switch 250 is arranged to open upon the pressure in the cooling circuit falling to a level in the order of −30 to −50 mmHg.

In order to control the level of coolant in the coolant jacket, a level sensor 252 is disposed as shown. It will be noted that this sensor 252 is located at a level (H1) which is higher than that of the combustion chambers, exhaust ports and valves (structure subject to high heat flux) so as to maintain same securely immersed in liquid coolant and therefore attenuate engine knocking and the like due to the formation of localized zones of abnormally high temperature or 'hot spots'.

Located below the level sensor 252 so as to be immersed in the liquid coolant is a temperature sensor 254. The output of the level sensor 252 and the temperature sensor 254 are fed to a control circuit 256 or modulator which is suitably connected with a source of EMF (not shown).

The control circuit 256 further receives an input from the engine distributor 258 (or like device) which outputs a signal indicative of engine speed and an input from a load sensing device 260 such as a throttle valve position sensor. It will be noted that as an alternative to throttle position, the output of an air flow meter or an induction vacuum sensor may be used to indicate load or the pulse width of fuel injection control signal. In the event that the engine to which the invention is applied is fuel injected the fuel injection control signal can be used to supply both load and engine speed signals. Viz., the width of the injection pulses can be used to indicate load (as previously mentioned) while the frequency of the same used to indicate engine speed.

A second level sensor 262 is disposed in the lower tank 220 at a level H2. The purpose for the provision of this sensor will become clear hereinafter when a discussion the operation of the embodiment is made with reference to the flow charts of FIGS. 9 to 18. However, it should be noted at this time that, when the level of coolant in the coolant jacekt is at level H1 and the level of coolant in the lower tank 220 is at level H2 the minimum amount of liquid coolant with which the cooling system cab be assuredly operated with, is contained therein.

Brief Operation Overview

Prior to use the cooling circuit is filled to the brim with coolant (for example water or a mixture of water and antifreeze or the like) and the cap 242 securely set in place to seal the system. A suitable quantity of additional coolant is also placed in the reservoir 226. At this time the electromagnetic valve 230 should be temporarily energized so as to assume a closed condition. Alternatively, and/or in combination with the above, it is possible to introduce coolant into the reservoir 226 and manually energize valve 236 in a manner to establish flow path A while simimiltaneously energizing pump 224 so as induct coolant from the reservoir via conduit 238 and pump same into the lower tank 220 until coolant can be visibly seen spilling out of the open riser. By securing the cap 242 in position at this time the system may be sealed in a completely filled state.

To facilitate this filling and subsequent servicing of the system a manually operable switch may be arranged to permit the above operation from 'under the hood' and without the need to actually start the engine.

When the engine is started, as the coolant jacket is completely filled with stagnant coolant, the heat produced by the combustion in the combustion chambers cannot be readily released via the radiator 216 to the ambient atmosphere and the coolant rapidly warms and begins to produce coolant vapor. At this time valve 230 is left de-energized (open) whereby the pressure of the coolant vapor begins displacing liquid coolant out of the cooling circuit (viz., the coolant jacket 208, vapor manifold 212, vapor conduit 214, radiator 216, lower tank 220 and return conduit 222).

During this 'coolant displacement mode' it is possible for either of two situations to occur. That is to say, it is possible for the level of coolant in the coolant jacket 208 to be reduced to level H1 before the level in the radiator 216 reaches level H2 or vice versa, viz., wherein the radiator 216 is emptied to level H2 before much of the coolant in the coolant jacket 208 is displaced. In the event that latter occurs (viz., the coolant level in the radiator falls to H2 before that in the coolant jacket reaches H1), valve 230 is temporarily closed and an amount of the excess coolant in the coolant jacket 208 allowed to 'distill' over to the radiator 216 before valve 230 is reopened. Alternatively, if the level H1 is reached first, level sensor 252 induces the energization of pump 224 and coolant is pumped from the lower tank 220 to the coolant jacket 208 while simultaneously being displaced out through conduit 228 to reservoir 226.

The load and other operational parameters of the engine (viz., the outputs of the sensors 258 and 260) are sampled and a decision made as to the temperature at which the coolant should be controlled to boil. If the desired temperature is reached before the amount of the coolant in the cooling circuit is reduced to its minimum permissible level (viz., when the coolant in the coolant jacket and the radiator are at levels H1 and H2 respectively) it is possible to energize valve 230 so that is assumes a closed state and places the cooling circuit in a hermetically closed condition. If the temperature at which the coolant boils should exceed that determined to be best suited for the instant set of engine operational conditions, three-way valve 236 may be set to establish flow path A and the pump 224 energized briefly to pump a quantity of coolant out of the cooling circuit to increase the surface 'dry' (internal) surface area of the radiator 216 available for the coolant vapor to release its latent heat of evaporation and to simultaneously lower the pressure prevailing within the cooling circuit. It should be noted however, that upon the coolant in the circuit being reduced to the minimum level (viz., when the levels in the coolant jacket 208 and the lower tank 220 assumes levels H1 and H2 respectively) the displacement of coolant from the circuit is terminated in order to prevent a possible shortage of coolant in the coolant jacket 208.

On the other hand, should the ambient conditions be such that the rate of condensation in the radiator 216 is higher than that desired (viz., be subject to overcooling) and the pressure within the system overly lowered to assume a sub-atmospheric level, three-way valve 236 is conditioned to produce flow path A and the pump 224 operated to induct coolant from the reservoir 226 and force same into the radiator 216 via the lower tank 220 until it rises to a suitable level. With this measure, the pressure prevailing in the cooling circuit is raised and the surface area available for heat exchange reduced.

Accordingly, the boiling point of the coolant is immediately modified by the change in internal pressure while the amount of heat which may be released from the system reduced. Accordingly, it is possible to rapidly elevate the boiling point to that determined to be necessary.

When the engine 200 is stopped it is advantageous to maintain valve 230 energized (viz., closed) until the pressure differential responsive switch arrangement 250 opens. This obviates the problem wherein large amounts of coolant are violently discharged from the cooling circuit due to the presence of superatmospheric pressures therein.

The above briefly disclosed operations will become more clearly understood as the description of the the flow charts shown in FIGS. 13 to 22 proceeds.

System Control Routine

Figure 9:
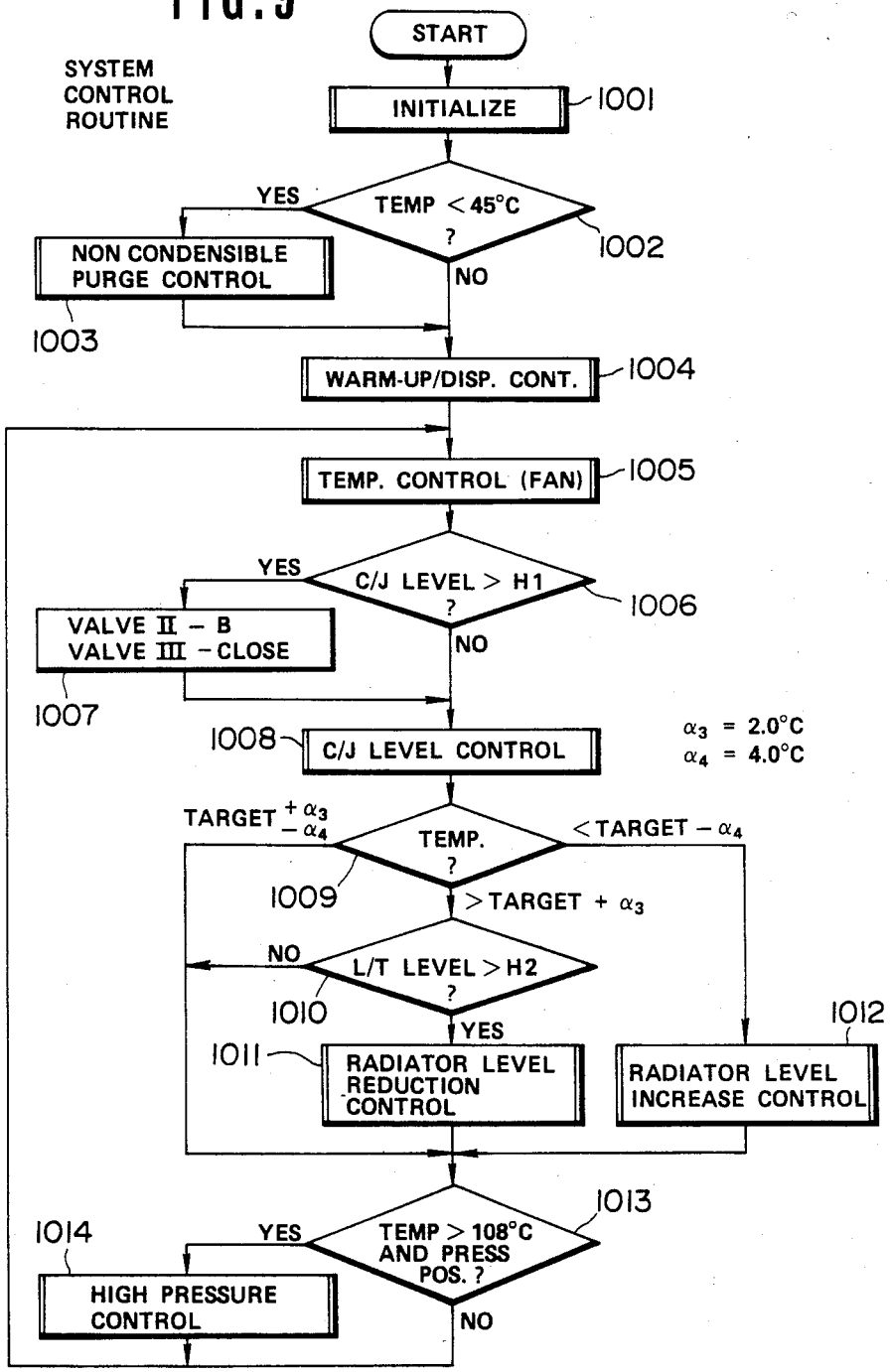
FIGS. 9 to 19 are flow charts showing the steps which characterize the operation of the present invention.
Figure 10:
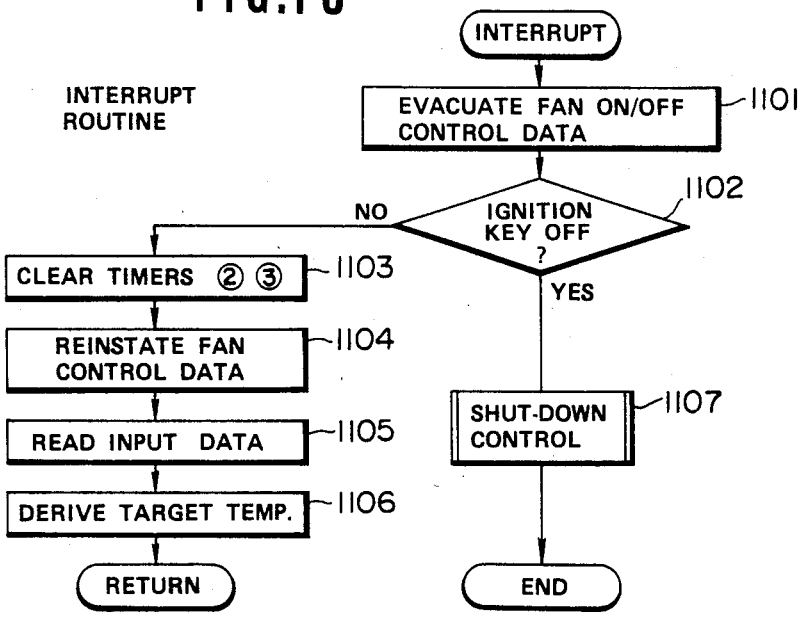
Figure 18:
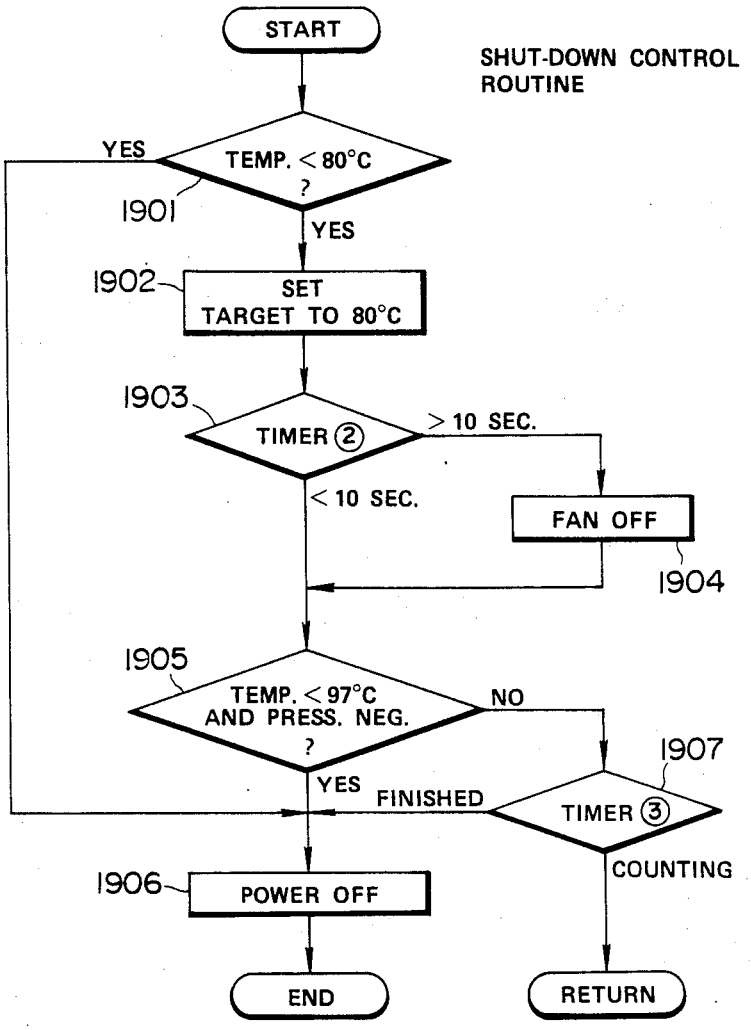

FIG. 9 shows in flow chart form the steps which characterize the control of the system during operation other than the shut-down control which will be discussed in detail hereinlater with reference to FIG. 18.

The first step of the system control is to initialize the system—viz., the RAM of the microprocessor which forms the heart of the control circuit 256 is cleared and the peripheral interface adapter initially set whereafter interrupts are permitted. At step 1002 the output of the temperature sensor 254 is sampled and a determination made whether the temperature of the coolant is above or below a predetermined lower limit which in this case is selected to be 45° C. If the temperature is above this level then the program by-passes step 1003 and goes directly to step 1004 wherein a warm-up/displacement mode is entered on the assumption that as the coolant is still warm the engine has not be stopped long and there has been little chance for atmospheric air to have leaked into the system to any degree. However, if the temperature is lower than 45° C. then at stp 1003 a non-condensible purge control routine is run. This control is such as to overfill the system and flush out any air or the like which might have entered during the non-use of the system.

At step 1005 a control routine which regulates the temperature of the coolant via selective energization of fan 218 is run. Following this the level of coolant in the coolant jacket 208 is checked in step 1006. If the outcome of this enquiry is such as to indicate that the level in the coolant jacket is above level H1 then at step 1007 valve II is conditioned to produce flow path B and valve III closed. This places the system in a closed circuit state with fluid communication between the radiator 216 and the coolant jacket established.

Following both of steps 1006 and 1007 a coolant level control routine is run at step 1008. With this arrangement the level of coolant in the coolant jacket is maintained at H1 irrespective of the system being in a closed circuit condition or not. Following this, the temperature of the coolant in the coolant jacket is sampled by reading the output of the temperature sensor 254 and ranged against a 'target' value which is determined on the basis of the instant mode of engine operation. Viz., if the engine is found to be operating in zone A for example, the value of 'TARGET' is set at a value between 100° and 110° C. The derivation of this value will be dealt with in detail hereinlater in connection with the interrupt routine of FIG. 14.

In the event that the temperature is found to be within a range of TARGET$+\alpha$3 to TARGET$-\alpha$4 then the program flows immediately to step 1013. However, if the temperature is above TARGET$+\alpha$3 then at step 1010 the level of coolant in the lower tank (L/T) 220 is determined by sampling the output of sensor 262 to ascertain whether the reason for the high temperature is excess coolant in the radiator 216 which is reducing the effective heat exchange surface area of the same. If the outcome of this enquiry is negative the program flows to step 1013. However, in the event that some excess coolant is found to be in the radiator then at step 1011 a routine which reduces the level of coolant is run. On the other hand, if the outcome of the enquiry conducted at step 1009 indicates that the temperature of the coolant is lower than desired the program flows to step 1012 wherein steps are implemented to increase the amount of coolant in the radiator and thus reduce the amount of dry surface area available for coolant vapor to release its latent heat of evaporation and condense. As will be appreciated steps 1011 and 1012 are such as to control the temperture of the coolant boiling point by tailoring the heat exchange characteristics of the radiator 216 to that suited for the instant set of operational conditions. This in combination with the temperature control effected by the operation of fan 218 enables rapid and stable control of the coolant temperature.

However, in the event that program flows to step 1013 it is deemed that non-condensible matter has appeared in the system and has reduced the efficiency of the radiator to the point of inducing a potential engine overheat condition. Accordingly, both the output of the coolant sensor 254 and the pressure differential switch arrangement 250 are sampled and in the event that the temperature is above 108° C. and the pressure is superatmospheric then at step 1014 a control routine which performs what shall be referred to as a 'hot purge' is run.

Before dealing with each of the above mentioned routines in detail it is deemed appropriate to firstly discuss the interrupt which is performed at frequent intervals to determine the current operational status of the engine.

Interrupt Routine

This routine (FIG. 10) is run in the form of an interrupt at predetermined time intervals so as to frequently determine the current status of the engine. Each time this routine is run the current fan control data is evacuated from the CPU in order to clear the way for subsequent operations. At step 1102 the status of the ignition key is sampled and in the event that it is ON indicating that the engine is running the program flows to steps 1103 to 1106 wherein timers 2 and 3 (soft clocks used in shut-down routine) are cleared, the fan control data reinstated in the CPU and the inputs from sensors 258 and 260 read in preparation for the derivation of the 'Target' temperature (step 1106).

Figure 1:
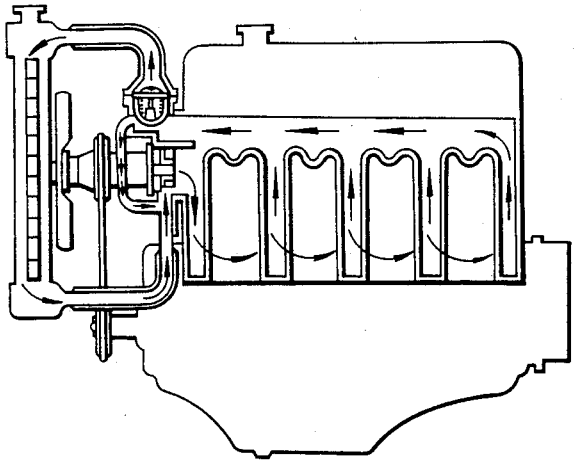
FIG.1 (PRIOR ART)
FIGS. 1 to 4 show the prior art arrangements discussed in the opening paragraphs of the instant disclosure.
Figure 2:
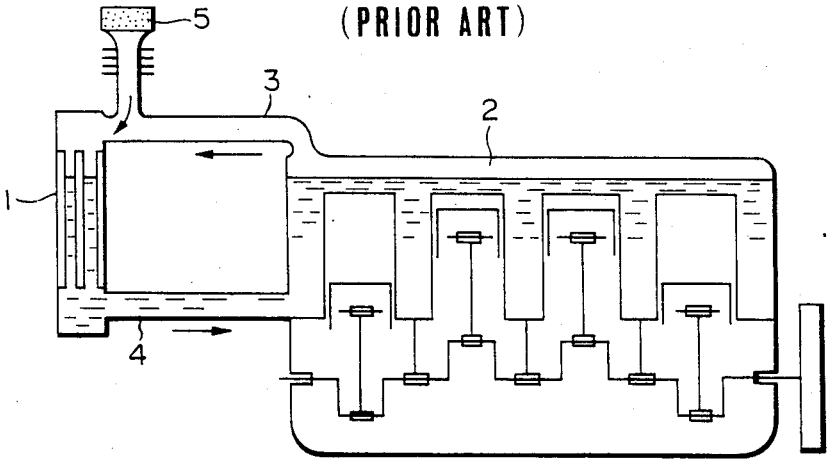
FIG.2 (PRIOR ART)
Figure 3:
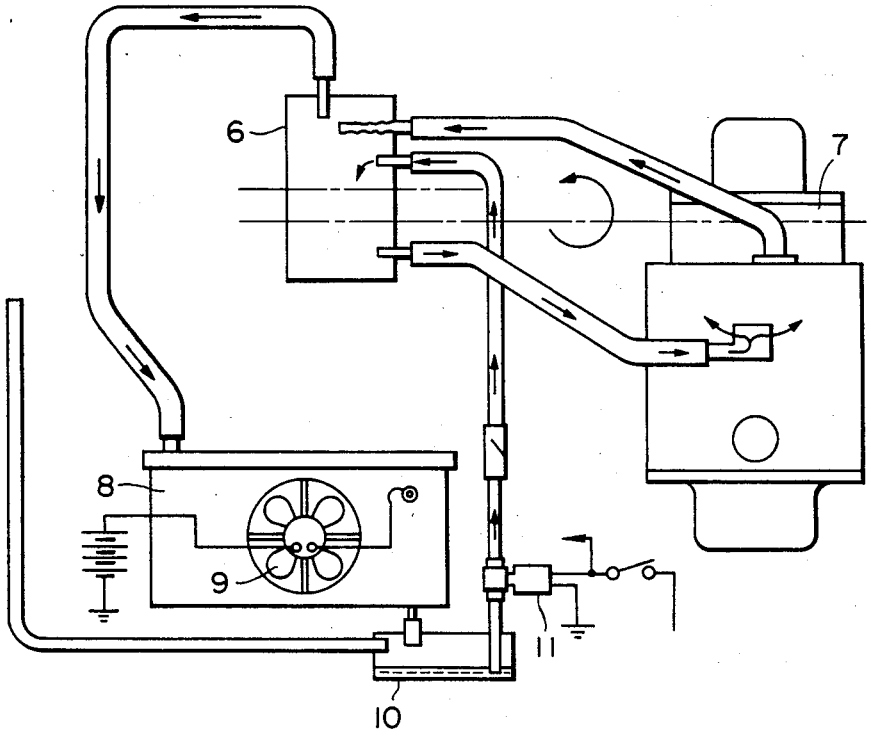
FIG.3 (PRIOR ART)
Figure 4:
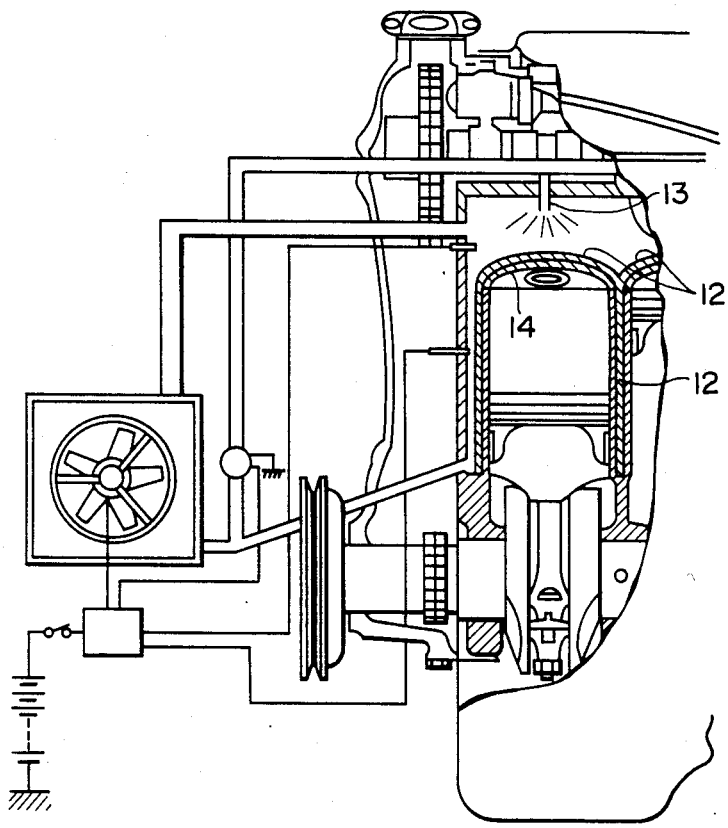
FIG.4 (PRIOR ART)
Figure 5:
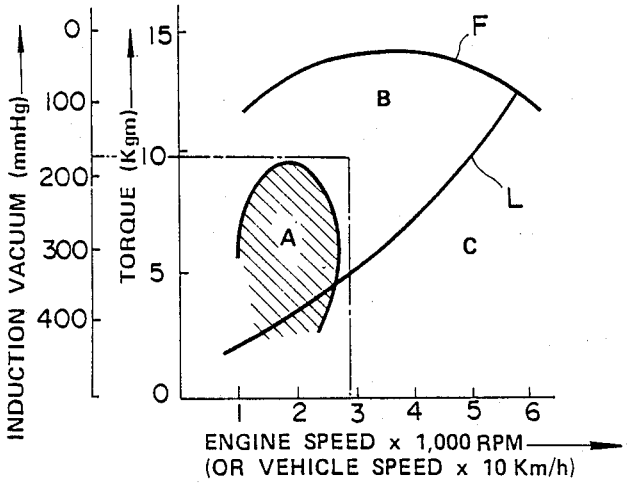
FIGS. 5 is a diagram showing in terms of engine load and engine speed the various load zones which are encountered by an automotive internal combustion engine.
Figure 6:
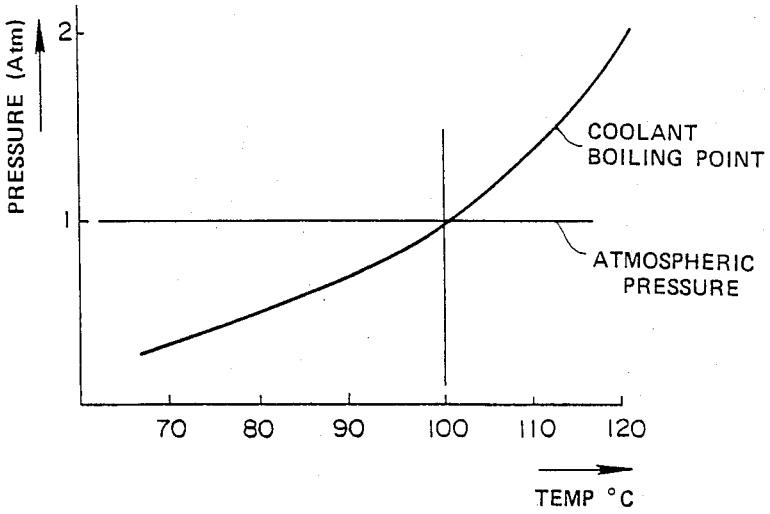
FIG. 6 is a graph showing in terms of pressure and temperature the changes in the coolant boiling point in a closed type evaporative cooling system.

As will be appreciated from the discussion of the three zones shown in FIG. 5 as the instant embodiment employs a microprocessor, it is a relatively simple matter to set data such as a two dimensional table of the nature of that shown in said figure in the ROM and use the load and engine speed inputs from sensors 258 and 260 to determine which load and which temperature range should be employed under the instant set of operational conditions. Alternatively, it is possible to develop an algorithm in program form which will perform the same function. As such details are well within the grasp of one skilled in the art of computer programming no further discription will be given for brevity.

However, if at step 1102 it is discovered that the ignition key is OFF then at step 1107 a routine which controls the cooling of the system to the point where it is safe to render the system open circiut without encountering the problem wherein superatmospheric pressurse cause a discharge of coolant from the cooling circiut to the reservoir of sufficient violence that coolant is apt to the lost via spillage and/or large quantities of air permitted to enter the system.

Each of the above mentioned sub-routines will be now be dealt with one by one with reference to FIGS. 10 to 19.

Non-condensible Matter Purge Control Routine

Figure 11:
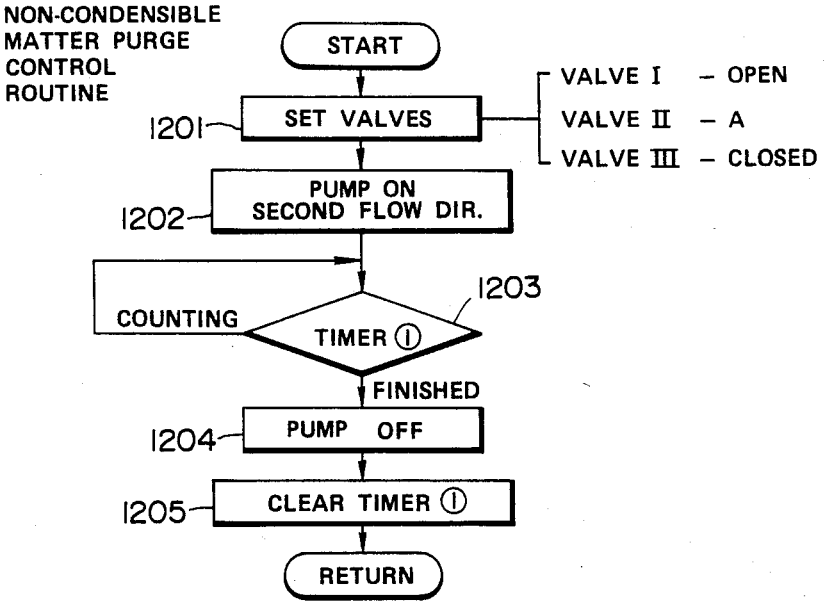

FIG. 11 shows in detail the steps which characterize the control of the non-condensible matter purge mode. At step 1201 the three electromagnetic valve 248, 236 and 230 are conditioned as shown. For the ease of explanation these valves shall be referred to simply as valves I, II and III respectively. Viz. valve I (248) is energized so as to assume an open state and thus permit fluid communication between the riser 240 and the reservoir 226 via overflow conduit 246, valve II (236) set so as to assume a condition wherein flow path A is established (viz., fluid communication between the reservoir 226 and the lower tank 220), and valve III (230) is closed. At step 1202 pump 224 is energized so as to pump coolant in the second flow direction (viz., toward the lower tank). This causes introduce coolant (from reservoir 226) in a manner that it flows up through the radiator 216 toward the riser 240 and thus flushes out any stubborn bubbles of air that may have found their way into the system and collected in the radiator tubing.

As the cooling circuit is essentially full at this time the excess coolant soon spills oven to the reservoir 226 via the return conduit 246. The operation of pump 224 is maintained for a predetermined period of time (which can be set between several seconds and several tens of seconds—for example from 5 to 60 seconds) by a soft clock or first timer (timer 1) which arranged to count down by one each time a clock pulse or like signal is produced within the microprocessor in which the instant set of programs are being run. While this clock or timer is counting the program recycles to step 1203 as shown. Subsequently, upon the timer having counted down (or alternatively up) by the required amount, the program flows on to step 1204 wherein the operation of the pump 224 is stopped and timer 1 (first timer) cleared ready for the next purge operation.

Warm-up/Displacement Control Routine

Figure 12:
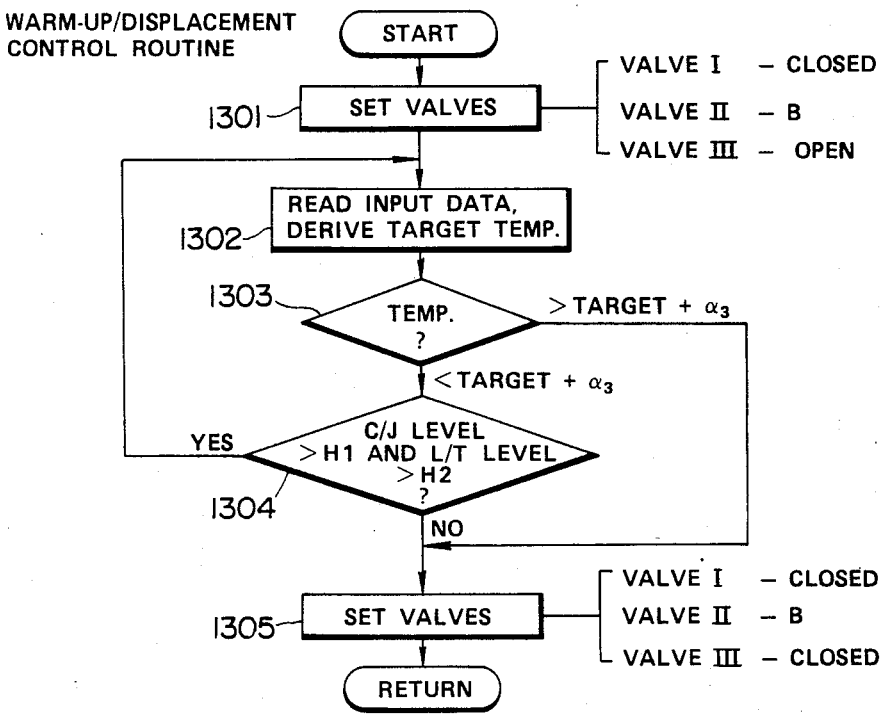

FIG. 12 shows the control steps which characterize the control of the warm-up/displacement control mode of operation. As shown in step 1301 valves I, II and III (i.e. valves 248, 236 and 230) are conditioned in a manner which closes the overflow conduit 246 establishes flow path B and which de-energizes valve III (230) to open conduit 228. At step 1302 the data input from the sensors 258 and 260 are read and a determination made as to the most appropriate temperature for the coolant to be induced to boil, via calculation or otherwise suitably looked-up.

At step 1303 the output of the coolant temperature sensor 254 is sampled and compared with the TARGET value determined in step 1302. If the coolant temperature is above TARGET by a value $\alpha 3$ (wherein $\alpha=2.0°$ C.) then the program flows to step 1305 while in the event that the coolant temperature has not come within TARGET$+\alpha 3$ then at step 1304 the output of level sensors 252 and 262 are sampled and it is determined if the level of coolant in both of the coolant jacket 208 (C/J) and the lower tank 220 (L/T) are below levels H1 and H2 respectively. if the outcome of this enquiry is negative, then the coolant circuit is considered to still contain an amount of coolant in excess of the above mentioned minimum amount and the program recycles to step 1302 to allow for further displacement. However, if one of the levels has reached the respective predetermined value, then in order to prevent either an excessively low level in the coolant jacket 208 or for the excess coolant in the coolant jacket to be in part moved to the raditator 216 via the previously mentioned 'distillation' process, the valves are conditioned as shown. Viz., valve I is closed, valve II flow path B is established and valve III is energized to assume a closed state.

Following the return of the warm-up/displacement control mode the temperature control (fan) program is run.

Temperature Control Routine

Figure 13:
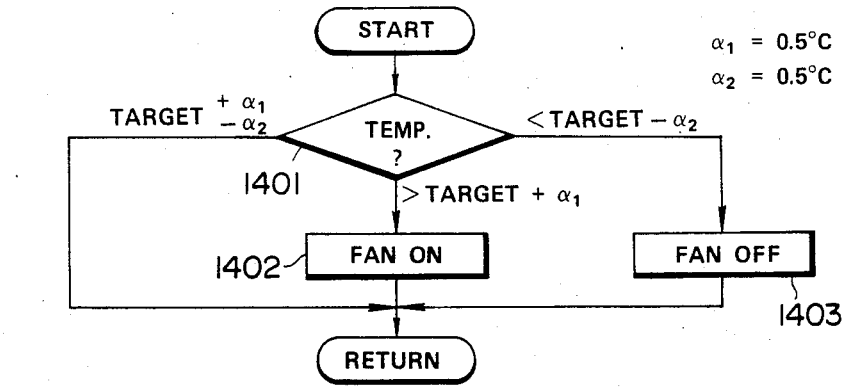

As shown in FIG. 13, at step 1401 of this routine the data inputs from sensors 258 and 260 are read and and the TARGET temperature determined. At step 1401 the instant coolant temperature is determined by sampling the output of temperature sensor 254 and compared with the derived TARGET value. The temperature is ranged as shown. Accordingly, if the instant coolant temperature is within a range of TARGET$+$a1 to TARGET$-\alpha 3$ (wherein $\alpha 1=0.5°$ C.$=\alpha 2$) then the routine terminates. However, if the temperature is lower than TARGET$-\alpha 2$ then the operation of the cooling fan 218 is prevented while if above TARGET$+\alpha 1$ then at step 1403 a command to energize fan 218 is issued.

Coolant Level Control Routine

Figure 14:
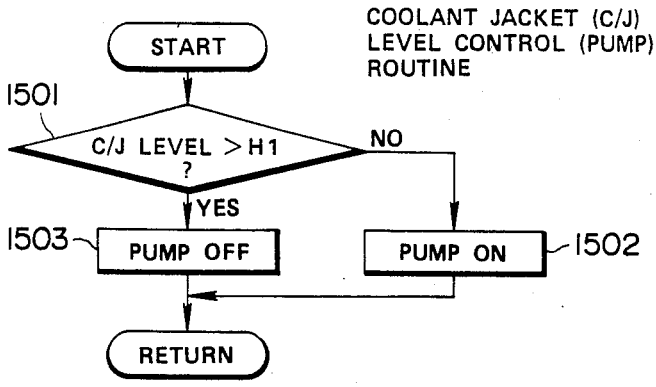

FIG. 14 shows the coolant level control routine which is run after each temperature control rountine execution. At step 1501 of this program the level of the coolant in the coolant jacket 208 is determined by sampling the output of level sensor 252. If the level of coolant in the coolant jacket 208 (C/J) is below H1 then at step 1502 a coolant jacket level abnormality check routine is run. However, if the level of coolant is found to be above sensor 262 then at step 1503 a command to stop the operation of pump 224 is issued. Following this timer 4 (used in the abnormality check routine) is cleared in step 1504 and the routine returns.

Abnormally High Temperature Control Routine

As will be appreciated from flow chart depicting the overall system control (FIG. 9) this control routine is run in response to the detection of an abnormally high temperature and pressure prevailing in the cooling circuit (step 1013) and in the event that the coolant levels in the coolant jacket 208 and the lower tank 220 are both at H1 and H2, respectively.

Figure 15:
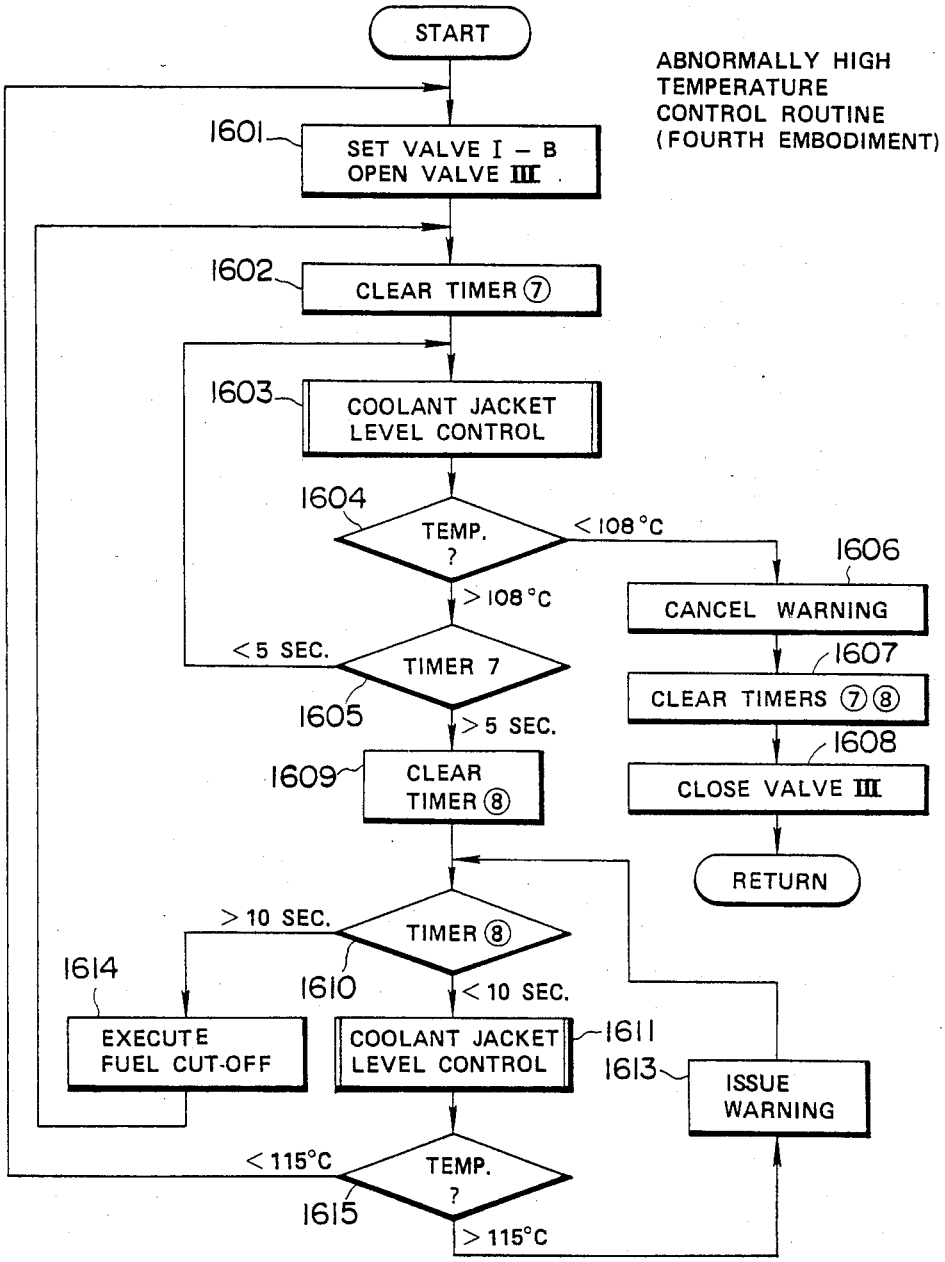

As shown in FIG. 15 this control routine is such that at step 1601 the cooling circuit is rendered open circuit by opening valve 230 and maintaining valve 236 set to provide communication between the lower tank 220 and the coolant jacket 208 (flow path B). At step 1602 a soft clock 'timer 7' is cleared and at step 1603 the coolant jacket level control routine is run. Following this at step 1604, the output of temperature sensor 252 is sampled and in the event that the coolant temperature is found to be greater than 108° C. timer 7 is set counting in step 1605.

If the temperature of the coolant drops below 108° C. within five seconds the program goes to step 1606 wherein a command to terminate the issuance of a high temperature warning is issued and thereafter flows to steps 1607 and 1609 wherein timers 7 and 8 are cleared and valve II is closed to return the system to a closed circuit state again.

However, if the high temperature persists for more than 5 seconds, then at step 1609 timer 8 is cleared and subsequently started in the next step (1610). As will be noted timer 8 is arranged to count over a period corresponding to 10 seconds. While the count remains within this period the program goes to step 1611 wherein the level of coolant in the coolant jacket 208 is monitored and adjusted to level H1; and thereafter goes to step 1612 wherein the temperature is ranged against a maximum permissible value of (in this case) 115° C. If the temperature is above this level the program recycles to step step 1610 and issues a warning indicating the very high temperature (step 1611). If this high temperature condition cannot be brought under control either by the driver reducing speed in response to the warning issued in step 1613, or automatically by the system, within a period of 10 seconds then at step 1614 a command to execute a partial fuel cut-off is issued in order to reduce the maximum vehicle speed to 50 km/hr (for example) in an effort to obviate any extensive thermal damage or the like to the engine. It will be noted that the fuel cut-off command is preferably not automatically cancellable buy the software as the possibility of a major system malfunction is quite high.

Radiator Level Reduction Control Routine

Figure 16:
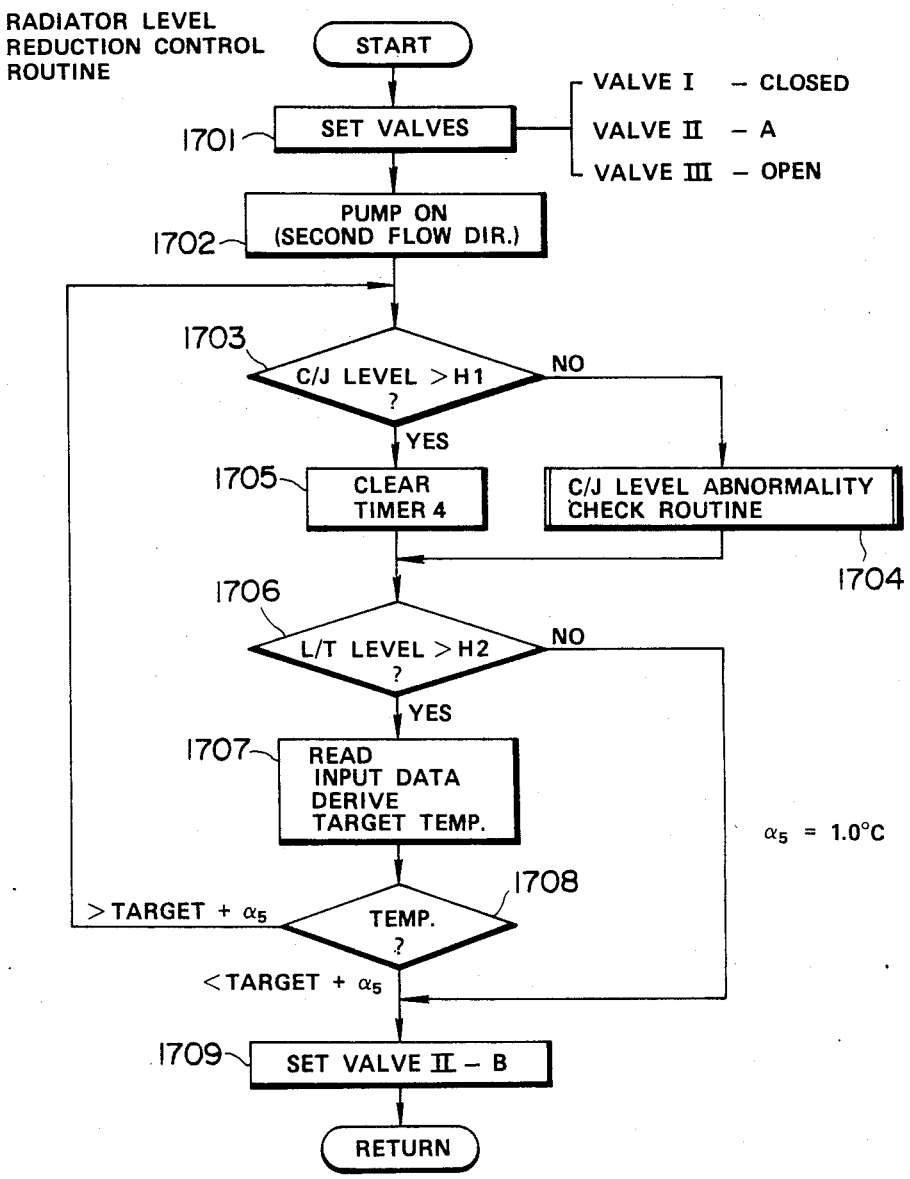

FIG. 16 shows in flow chart form the steps which characterize the control via which the level of coolant in the cooling circuit is reduced for the purposes of coolant temperature control. As shown the first step (1701) of this control routine involves the conditioning of the valves so that valve I is closed, valve II establishes flow path A and valve III is energized to assume a closed state. At step 1702 pump 224 is energized so as pump coolant in the second flow direction (viz., from the lower tank toward valve II (236). Under these conditions coolant is withdrawn from the lower tank 220 and forced out to the reservoir 226 via conduit 238.

At step 1703 the coolant level in the coolant jacket 208 is checked to determine if the level of coolant therein has dropped to H1 or not. In the event that the level has not dropped to H1 then the program flows to step 1704 wherein the coolant jacket abnormality chech routine is implemented. On the other hand, if the level in the coolant jacket has in fact dropped to level H1 then at step 1705 a command to clear timer 4 is issued and at step 1706 the coolant level in the lower tank 220 is determined by sampling the output of level sensor 262. In the event that the level of coolant in the lower tank 220 is below level H2 then the program proceeds to step 1707 wherein the outputs of sensors 258 and 260 are sampled and the TARGET temperature determined. However, if the level of coolant in the lower tank 220 is still above H2 then the program by-passes steps 1707 and 1708 as shown.

At step 1708 the instant coolant temperature is compared with the TARGET value derived in step 1702. In the event that the coolant temperature is greater than TARGET+$\alpha$5 (wherein $\alpha$5=1.0° C.) then the program returns to step 1703 in an effort to induce a further reduction in coolant and thus internal pressure while in the event that the coolant temperature is lower than TARGET+$\alpha$5 then the program flows to step 1709 wherein flow path B is established via suitable conditioning of valve II.

As will be appreciated this control strives to lower the temperature of the coolant to a value which is within 1.0° C. of the desired TARGET value and is executed in response to the temperature ranging and level sensing steps 1009 and 1010 of the system control routine shown in FIG. 13.

Radiator Level Increase Control Routine

Figure 17:
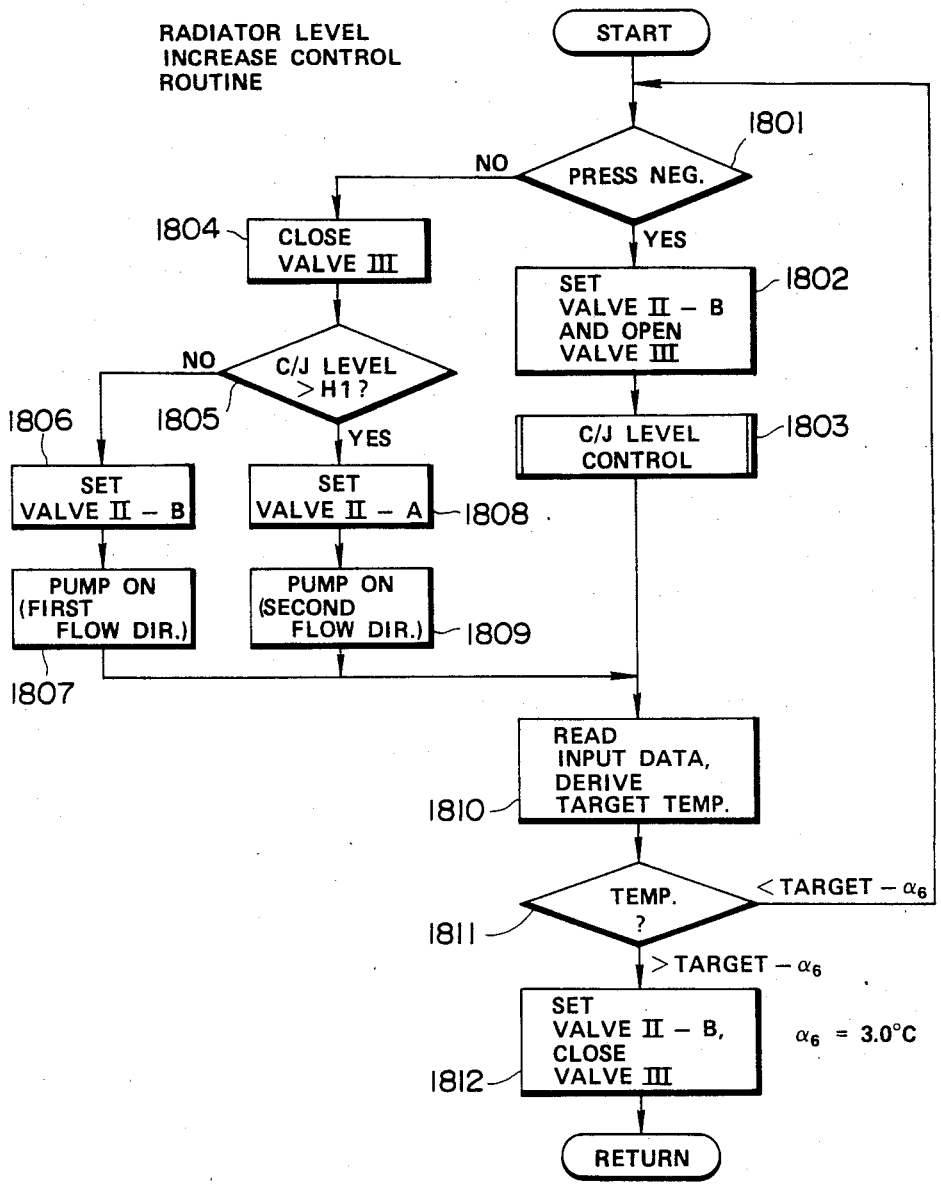

FIG. 17 shows in detail the steps which characterize the operation wherein the amount of coolant within the cooling circuit is increased in an effort to raise the pressure within the cooling circuit and thus raise the boiling point of the coolant. It will be noted that this control is executed in response to the temperature ranging executed in step 1009 of FIG. 9.

As shown, subsequent to the start of this routine the pressure prevailing in the cooling circuit is sampled and the determination as to whether the pressure is negative of not (step 1801). This of course can be determined by sampling the output of the pressure differential responsive switch 250.

In the event that the pressure within the cooling circuit is in fact negative then the program proceeds to step 1802 wherein valve II is condition to provide flow path B while valve III is de-energized to assume an open state. This permits coolant to be inducted into the coolant circuit under the influence of the pressure differential which exists between the ambient atmosphere and the interior of the cooling system. At step 1803 the coolant level control routine shown in FIG. 17 is executed.

On the other hand, if the pressure within the cooling circuit is not lower than atmospheric then at step 1804 valve III is energized so as to asume a closed state. At step 1805 the coolant level in the coolant jacket 208 is determined and if lower than H1 then at step 1806 valve II is conditioned to provide flow path B and at step 1807 pump 224 is energized in a manner to pump liquid coolant in the first flow direction. However, if the coolant level in the coolant jacket 208 is above H1 then flow path A is established and pump 224 operated to pump coolant in the second flow direction. This of course positively inducts coolant from the reservoir 226 and forces same into the cooling circuit (radiator 216) to increase the pressure prevailing therein.

At step 1810 the TARGET temperature is derived and at step 1811 the instant coolant temperature compared with the derived value. In the event that the coolant temperature is below TARGET−$\alpha$6 then the program recycles to step 1801 in order to permit further coolant to be introduced into the cooling circuit.

However, if the temperature is greater than TARGET−$\alpha$6 then at step 1812 flow path B is established and valve III closed thus terminating the influx of coolant.

Shut-down Control Routine

At step 1901 (FIG. 18) it is determined if the temperature of the engine coolant is above a predetermined level which in this embodiment is selected to be 80° C. If the temperature of the coolant is still below the just mentioned limit it is assumed that the cooling circuit can be rendered open circuit without fear of super atmospheric pressures causing a violent displacement of coolant out of the circuit to the reservoir in a manner which invites spillage and permanent loss of coolant. On the other hand, if the coolant is still above 80° C. then the program flows to step 1902 wherein the TARGET temperature is set to the just mentioned value. At step 1903 a second timer (timer 2) is set counting. In this embodiment the period for which the second counter is arranged to count over is selected to be 1 minute. If desired this value can be increased or decreased in view of the engine which is cooled by the system according to the present invention. Upon completion of the count the operation of fan 218 is terminated in step 1904.

At step 1905 enquiries relating to the temperature and pressure status of the interior of the cooling circuit are carried out. Viz., it is determined if the coolant temperature is below 97° C. and the pressure prevailing within the system negative.

If both of these requirements are met then at step 1906 power to the entire system is cut off. However, if one or the other of the two requirements is not met then the program flows to step 1907 wherein timer 3 is set counting and the program goes to RETURN. The period for which the third counter is arranged to count is in this embodiment is 1 minute. When the third counter completes its count the program is permitted to go to to step 1906 and terminate. Thus, as will be understood, if counter 3 is set counting the shut-down control routine may be run a number of times before the power to the entire system is cut-off. This of course ensures that the above mentioned spillage etc., will not occur.

Coolant Jacket Coolant Level Abnormality Check Routine

Figure 19:
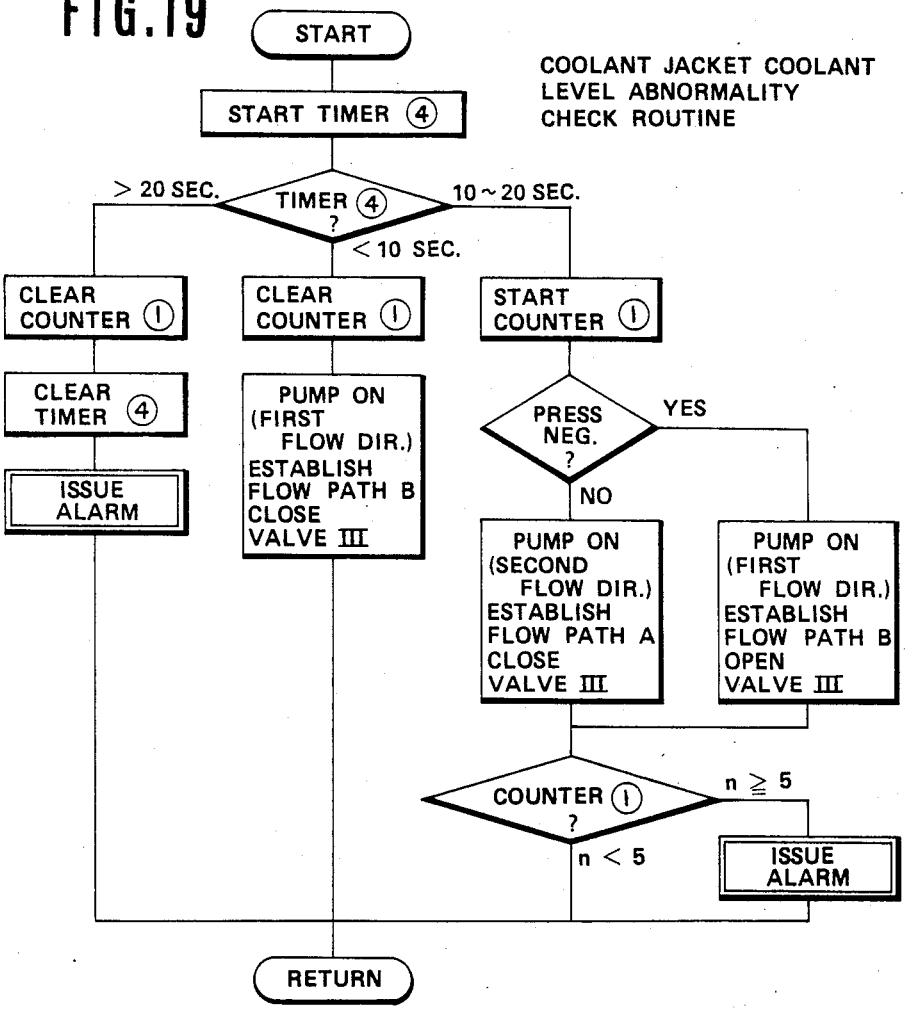

FIG. 19 shows the steps which characterize the routine which moniotrs the output of the coolant jacket level sensor 252 and which issues a warning the event that the operation of the system is such as to indicate that a prolonged or chronic lack of coolant has occur in the coolant jacket. This routine is run as an interrupt each time the level sensor 252 assumes an OFF condition. It will be noted that with the present invention the provision wherein the level sensor produces a low level or OFF signal in the event of the coolant in the coolant jacket 208 dropping below level H1 is beneficial from the view point that if the sensor malfunctions and fails to produce an output then the control system will attempt to continue to fill the coolant jacket and thus ensure that too much rather than too little coolant is fed thereinto.

As shown, the first step of this routine is such as to set soft clock or timer 4 counting. At step 2002 the period for which timer 4 has been counting is checked. In the event that the time since level sensor 252 has begin outputting a level level signal is less than 10 seconds then the program flows to step 2003 wherein a soft counter (counter 1) is cleared and then goes to step 2004 whrerein a commands to energize pump 224, to condition valve 236 (II) to produce flow path B and to close valve 230 (III) are issued. This later mentioned step conditions the system so that coolant will be moved from the lower tank 220 and fed into the coolant jacket 208. With the system in this state the program returns. In the event that the level sensor 252 still indicates that the coolant level is below H1 then the control steps shown in FIG. 14 are implemented.

During subsequent interrupts while the period from the first interrupt remains below 10 seconds the program flows through steps 2003 and 2004.

However, if the time exceeds 10 seconds but is less than 20 seconds then the program flows to step 2005 wherein counter 1 is induced to count up by one. Viz., this counter is arranged to count up by 1 each run of the instant program. At step 2006 the output of the pressure differential swtich device 250 is sampled. In the event that the pressure in the cooling circuit is positive then at step 2007 the system is conditioned to induct coolant from the reservoir and introduce the same into the cooling circuit. Viz., pump 224 is energized to pump in the second flow direction while valve 236 (II) is set to produced flow path A.

However, if the the outcome of the enquiry at step 2006 is such as to indicate that the pressure in the cooling system has become sub-atmospheric then the program goes to step 2008 wherein the system is conditioned to permit coolant to be inducted into the system under the influence of the pressure differential which exists therebetween. Viz., valve 230 (III) is opened while valve 236 is conditioned to produce flow path B with pump 224 energized to pump in the the first flow direction. This increases the amount of coolant in the system without permitting a level increasing build-up of the same in the lower tank 220 and radiator 216.

At step 2009 the number of runs of the instant program with the time from the first interrupt between 10 and 20 seconds, is checked. In the event that a predetermined number (in this case 5) runs have been made it is deemed that a malfuction which is apt to cause engine damage if permitted to continue, has occured and at step 2010 an alarm to the vehicle operator is issued.

In the event that the number of runs has not exceed 5 but a period greater than 20 seconds has elapsed from the time of the first low signal from the level sensor 252 then the program flows to step 2011 wherein counter 1 is cleared. Subsequently, at step 2012 timer 4 is cleared and an alarm of the nature produced in step 2010 is generated.

It will be noted that timer 4 is cleared at step 1705 of the radiator level reduction control routine shown in FIG. 16.

As will be appreciated with this control if the level sensor 252 frequently indicates a low level or stays on continuously for a prolonged period it is possible to detect an abnormality in the system and produce an alarm at a time sufficiently early as to enable the engine to be saved from overheating and undergoing thermal damage.

What is claimed is:

1. In an internal combustion engine having a structure subject to high heat flux;

a cooling system for removing heat from said engine comprising:

a coolant jacket formed about said structure, said coolant jacket being arranged to receive coolant in liquid form and discharge same in gaseous form;

a radiator in which the gaseous coolant produced in said coolant jacket is condensed to its liquid form;

a vapor transfer conduit leading from said coolant jacket to said radiator for transfering gaseous coolant from said coolant jacket to said radiator;

a device associated with said radiator for varying the rate of heat exchange between said radiator and a cooling medium surrounding the radiator;

a liquid coolant return conduit leading from said radiator to said coolant jacket for returning coolant condensed to its liquid state in said radiator to said coolant jacket;

said coolant jacket, radiator, vapor transfer conduit and said liquid coolant return conduit defining a closed loop cooling circuit;

a reservoir the interior of which is maintained constantly at atmospheric pressure;

valve and conduit means for selectively interconnecting said reservoir and said cooling circuit;

a pump disposed in said coolant return conduit;

a first level sensor disposed in said coolant jacket and arranged to sense the level of liquid coolant in said coolant jacket at a first predetermined level above said structure, said first predetermined level being selected to immerse said structure in a predetermined depth of liquid coolant;

a control circuit responsive to said first level sensor for controlling the operation of said pump in a manner to maintain the level of liquid coolant in said coolant jacket at said first predetermined level;

said control circuit including means which monitors the output of said first level sensor and which issues a warning in the event that the one of the frequency and time for which said first level sensor indicates a level lower than said first predetermined level is outside of a predetermined range which defines malfunction free operation of the cooling system.

2. A cooling system as claimed in claim 1, further comprising a pressure differential device which is responsive to the difference in pressure between said cooling circuit and the ambient atmosphere and which is capable of issuing a signal indicative of a predetermined negative pressure prevailing in said cooling circuit, and wherein said monitoring means is responsive to the output of said pressure differential device for determining the occurence of a malfunction in the cooling system.

3. A cooling system as claimed in claim 1, wherein said pump is reversible and selectively energizable to pump coolant in (a) a first flow direction from said radiator toward said three-way valve and (b) in a second flow direction from said three-way valve toward said radiator.

4. A cooling system as claimed in claim 1, wherein said valve and conduit means further comprises:

a small collection vessel disposed at the bottom of said radiator for collecting condensate which precipitates thereoutof; and a second level sensor disposed in said vessel for indicating the level of liquid coolant being at a second predetermined level, said second predetermined level being selected in conjunction with said first predetermined level so that when the level of liquid coolant in said coolant jacket is at said first predetermined level and the level of coolant in said vessel is at said second predetermined level, the minimum amount of coolant which should be retained in the cooling circuit is contained therein.

5. A cooling system as claimed in claim 4, wherein said valve and conduit means further comprises:

a three-way valve disposed in said return conduit and a level control conduit leading from said three-way valve to said reservoir, said three-way valve having a first state wherein fluid communication between said radiator and said coolant jacket is interrupted and communication between said radiator and said reservoir established, and a second state wherein communication between said reservoir and said radiator is interrupted and communication between said radiator and said coolant jacket established;

a supply conduit which leads from said reservoir to said vessel at the bottom of said radiator;

a second valve disposed in said supply conduit, said second valve having a first position wherein communication between said reservoir and said radiator is established and a second position wherein the fluid communication between said radiator and said reservoir is cut-off;

an overflow conduit which fluidly communicates with said coolig circuit at a first end thereof and with said reservoir at the seond end thereof;

a third valve disposed in said overflow conduit, said third valve disposed in said overflow conduit, said third valve having a first position wherein fluid communication between said cooling circuit and said reservoir via said overflow conduit is prevented and a second position wherein fluid communication between said cooling circuit and said reservoir via said overflow conduit is established.

6. A cooling system as claimed in claim 5, wherein said control circuit includes means for operating said pump and said valve and conduit means in a manner which allows coolant to moved between said reservoir and said cooling circuit in a manner which varies the pressure in said cooling circuit.

7. A cooling system as claimed in claim 6, further comprising:

a temperature sensor disposed in said coolant jacket so as to be immersed in the liquid coolant therein; and an engine operational parameter sensor for sensing an engine operational parameter which varies with the load on the engine, said control circuit including means responsive to the output of said parameter sensor for controlling said device, said pump and said valve and conduit means in a manner to hold the temperature at which the coolant in said coolant jacket boils at a temperature which is determined in response to the output of said parameter sensor to be most suited for the instant set of operating conditions.

8. A method of cooling an internal combustion engine using a cooling system comprising the steps of:

introducing liquid coolant into a cooling circiut which includes a coolant jacket formed about structure of the engine subject to a high heat flux;

permitting the coolant in the coolant jacket to boil and produce coolant vapor;

transfering the coolant vapor to a radiator which defines a further section of said cooling circuit;

condensing the coolant vapor to its liquid form in said radiator;

sensing the level of coolant in said coolant jacket using a level sensor, said level sensor being arranged to sense the level of coolant being above a predetermined level which ensures that the structure is immersed in a predetermined depth of liquid coolant;

monitoring the output of said level sensor; and determining the possibility of a malfunction in said cooling system in the event that one of the frequency and time for which the sensor indicates a level lower than said predetermined one is not in a range determined to define malfunction free operation.

* * * * *